US010824093B2

(12) United States Patent
Hashimoto et al.

(10) Patent No.: US 10,824,093 B2
(45) Date of Patent: Nov. 3, 2020

(54) DEVELOPMENT DEVICE AND IMAGE FORMING APPARATUS

(71) Applicant: KYOCERA Document Solutions Inc., Osaka (JP)

(72) Inventors: Yasutaka Hashimoto, Osaka (JP); Hirofumi Tsuji, Osaka (JP); Hiroaki Ohashi, Osaka (JP); Hiroaki Takai, Osaka (JP); Masahiro Ueno, Osaka (JP); Tomoyasu Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/775,894

(22) Filed: Jan. 29, 2020

(65) Prior Publication Data

US 2020/0264535 A1 Aug. 20, 2020

(30) Foreign Application Priority Data

Feb. 19, 2019 (JP) ..... 2019-027751

(51) Int. Cl.
*G03G 15/08* (2006.01)

(52) U.S. Cl.
CPC ..... *G03G 15/0865* (2013.01)

(58) Field of Classification Search
CPC ..... G03G 15/0865
See application file for complete search history.

(56) References Cited

U.S. PATENT DOCUMENTS 6,684,039 B1 * 1/2004 Wazana ..... G03G 21/181 156/73.5
7,257,347 B2 * 8/2007 Okamoto ..... G03G 15/0875 399/109

FOREIGN PATENT DOCUMENTS

JP H0511667 A 1/1993

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A development device includes a rotational member and a housing. The housing includes a lower housing and an upper housing. The lower housing has an opened upper face. The upper housing has an opened lower face. A first edge portion around the opened upper face has a recess, a first contact face and a first opposite face. The first contact face is formed inside the recess. The first opposite face is formed outside the recess. A second edge portion around the opened lower face has a protrusion, a second contact face and a second opposite face. The protrusion is fitted into the recess. The second contact face comes into contact with the first contact face. The second opposite face opposes the first opposite face. The first and second contact faces are higher than the first and second opposite faces. The recess and the protrusion are adhered with an adhesive.

10 Claims, 14 Drawing Sheets

DEVELOPMENT DEVICE AND IMAGE FORMING APPARATUS

INCORPORATION BY REFERENCE

This application is based on and claims the benefit of priority from Japanese patent application No. 2019-027751 filed on Feb. 19, 2019, which is incorporated by reference in its entirety.

BACKGROUND

The present disclosure relates to a development device which develops an electrostatic latent image by a toner and an image forming apparatus including the development device.

An electrophotographic type image forming apparatus is provided with a development device which develops an electrostatic latent image by a toner. As shown in FIG. 13A to FIG. 14, the conventional development device 160 includes a housing 310 and a cover 311. The housing 310 has an upper opening 312, and screws 330 and a magnetic roller 320 are disposed therein. The upper opening 312 is covered with the cover 311 to prevent the developer from scattering from the housing 310.

In the above development device 160, the cover 311 is mounted to the housing 310 with a screw or the like. Between the housing 310 and the caver 311, an elastic member such as a sponge member is disposed to ensure a sealing performance. In order to improve a sealing performance, it is also possible to adhere the cover 311 to the housing 310. However, the cover 311 has a low rigidity because it is for preventing the toner scattering. Therefore, even if the cover 311 may be adhered to the housing 310, this does not so contribute to the improvement of a strength and a rigidity of the housing 310. In order to improve a strength and a rigidity of the housing 310, it is required to increase a wall thickness of the housing 310 and to use a material having a high Young's module. However, this causes problems such as an increase of cost and a difficulty of working due to the high Young's module. Additionally, in a case of where the cover is adhered to the hosing using an adhesive, the adhesive sometimes leaks inside the housing. Then, the adhesive solidified inside the hosing inhibits the agitation and the conveyance of the developer.

SUMMARY

In accordance with an aspect of the present disclosure, a development device includes a rotational member and a housing. The rotational member rotates around an axis. In the housing, the rotational member and a toner are stored. The housing includes a lower housing and an upper housing. The lower housing has a concave first storage part having an opened upper face. The upper housing has a concave second storage part having an opened lower face, and is disposed above the lower housing. The first storage part has a first edge portion around the opened upper face. The first edge portion has a recess, a first contact face and a first opposite face. The recess extends along the first edge portion and has an opened upper face. The first contact face is formed inside the recess. The first opposite face is formed outside the recess. The second storage part has a second edge portion around the opened lower face. The second edge portion has a protrusion, a second contact face and a second opposite face. The protrusion is fitted into the recess. The second contact face comes into contact with the first contact face. The second opposite face opposes the first opposite face. The first contact face is higher than the first opposite face. The second contact face is higher than the second opposite face. At least the recess and the protrusion are adhered with an adhesive.

In accordance with an aspect of the present disclosure, an image forming apparatus includes an exposure device forming an electrostatic latent image on a photosensitive drum; and the development device developing the electrostatic latent image.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
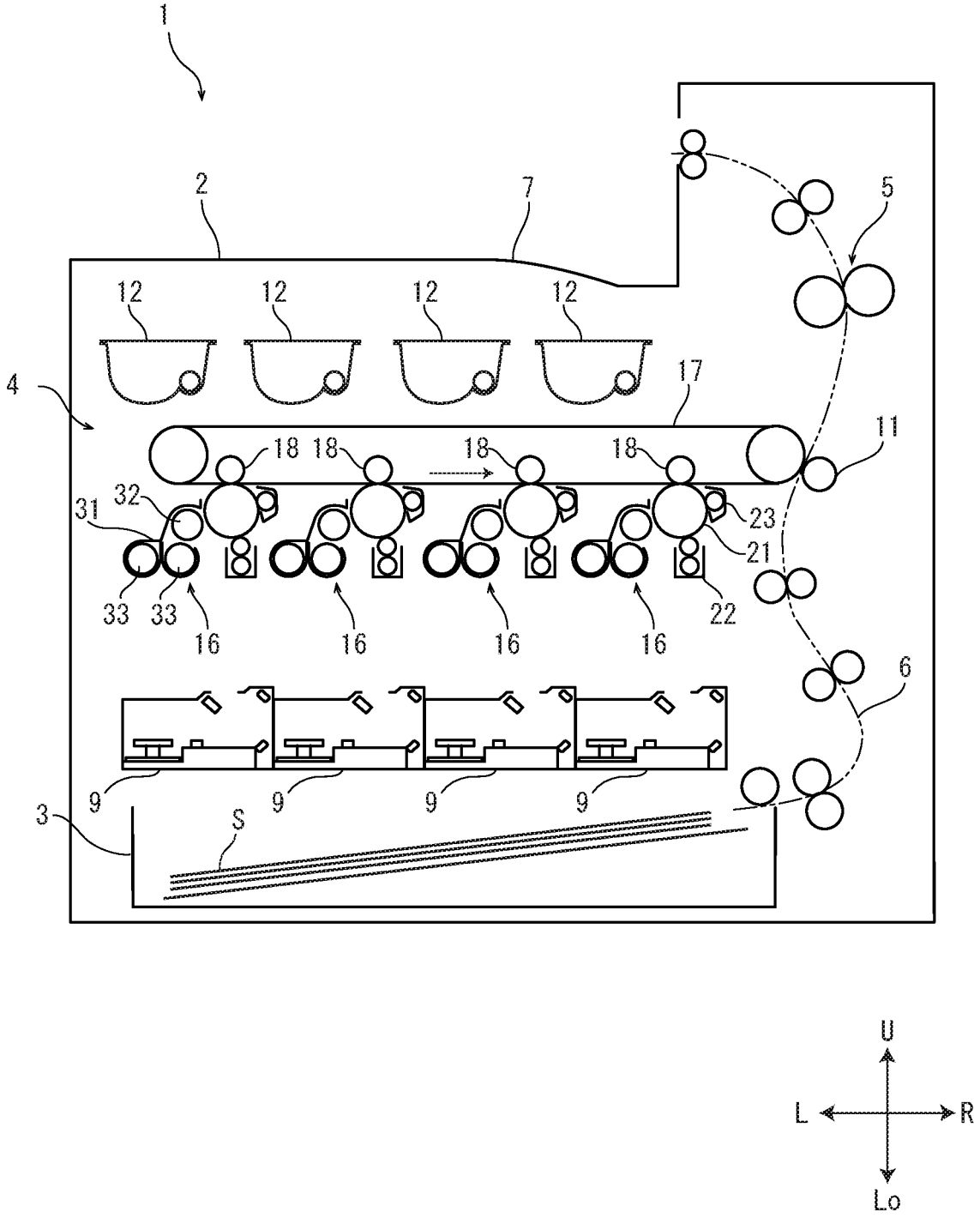
FIG. 1 is a front view schematically showing an inner structure of a printer according to one embodiment of the present disclosure.

Hereinafter, a printer 1 (an example of an image forming apparatus) and a development device 16 according to an embodiment of the present disclosure will be described with reference to the drawings. FIG. is a front view schematically showing an inner structure of the printer 1. In the following description, a near side (a front side) of a paper surface of FIG. 1 is defined to be a front side of the printer 1, and a left-and-right direction is defined based on a direction in which the printer 1 is viewed from the front side. In each figure, U, Lo, L, R, Fr and Rr respectively show an upper side, a lower side, a left side, a right side, a front side and a rear side.

The printer 1 includes a box-shaped casing 2. In the casing 2, a sheet feeding device 3 which feeds a sheet S to a conveyance path 6, an image forming part 4 which forms a toner image on the sheet S, a fixing device 5 which fixes the toner imager on the sheet S and a discharge part 7 which discharges the sheet S on which the toner image is fixed are stored.

The image forming part 4 includes a photosensitive drum 21, a charging device 22, an exposure device 9, a developer container 12, a development device 16, an intermediate transferring belt 17, a primary transferring roller 18, a secondary transferring roller 11 and a cleaning device 23. The photosensitive drum 21 is driven to be rotated. The charging device 22 charges the photosensitive drum 21. The exposure device 9 emits laser light based on an image data to the photosensitive drum 21 to form an electrostatic latent image on the photosensitive drum 21. The developer container 12 supplies a developer containing a toner to the development device 16. The development device 16 develops the electrostatic latent image by the toner to form a toner image. The intermediate transferring belt 17 is wound around a drive roller and a driven roller. The primary transferring roller 18 transfers the toner image to the intermediate transferring belt 17. The secondary transferring roller 11 transfers the toner image on the intermediate transferring belt 17 to the sheet S. The cleaning device 23 cleans the surface of the photosensitive drum 21. The printer 1 is provided with four sets of the photosensitive drum 21, the charging device 22, the exposure device 9, the developer container 12, the development device 16, the primary transferring roller 18 and the cleaning device 23, and configured to form a color image using the toners of four colors. The present disclosure may be applied to an image forming apparatus which forms an image using the toner of one color, or the toners of three or five or more colors.

The development device 16 includes a housing 31, a magnetic roller 32 and two screws 33 (an example of a rotational member). Between the housing 31 and the developer container 12, a developer supply path (not shown) is formed. The developer is a two-component developer containing a non-magnetic toner and a magnetic carrier, for example. The two screws 33 are disposed in the housing 31 parallel to each other. The magnetic roller 32 is disposed parallel to the screws 33, and its outer circumferential face is exposed from the housing to face the outer circumferential face of the photosensitive drum 21.

Next, an image forming operation of the printer 1 will be described. When the printer 1 receives an image data from an exterior computer or the like, the sheet S is fed to the conveyance path 6 from the sheet feeding device 3. Additionally, on the surface of the charged photosensitive drum 21, an electrostatic latent image is formed by the exposure device 9 based on the image data. The developer is supplied to the housing 31 from the developer container 12, and then agitated by the screws 33. The two screws 33 convey the developer in opposite directions to circulate the developer in the housing 31. The developer is carried on the magnetic roller 32 by magnetic force between the carrier and the magnetic roller 32. The toner contained in the carried developer is carried on the electrostatic latent image by a potential difference between the magnetic roller 32 and the photosensitive drum 21. As a result, the toner image is formed.

The toner images formed on the photosensitive drums 21 are overlapped and transferred on the intermediate transferring belt 17 by the primary transferring rollers 18. The toner image transferred on the intermediate transferring belt 17 is transferred on the sheet S by the secondary transferring roller 11, and then fixed on the sheet S by the fixing device 5. The sheet S on which the toner image is fixed is discharged to the discharge part 7.

Figure 2:
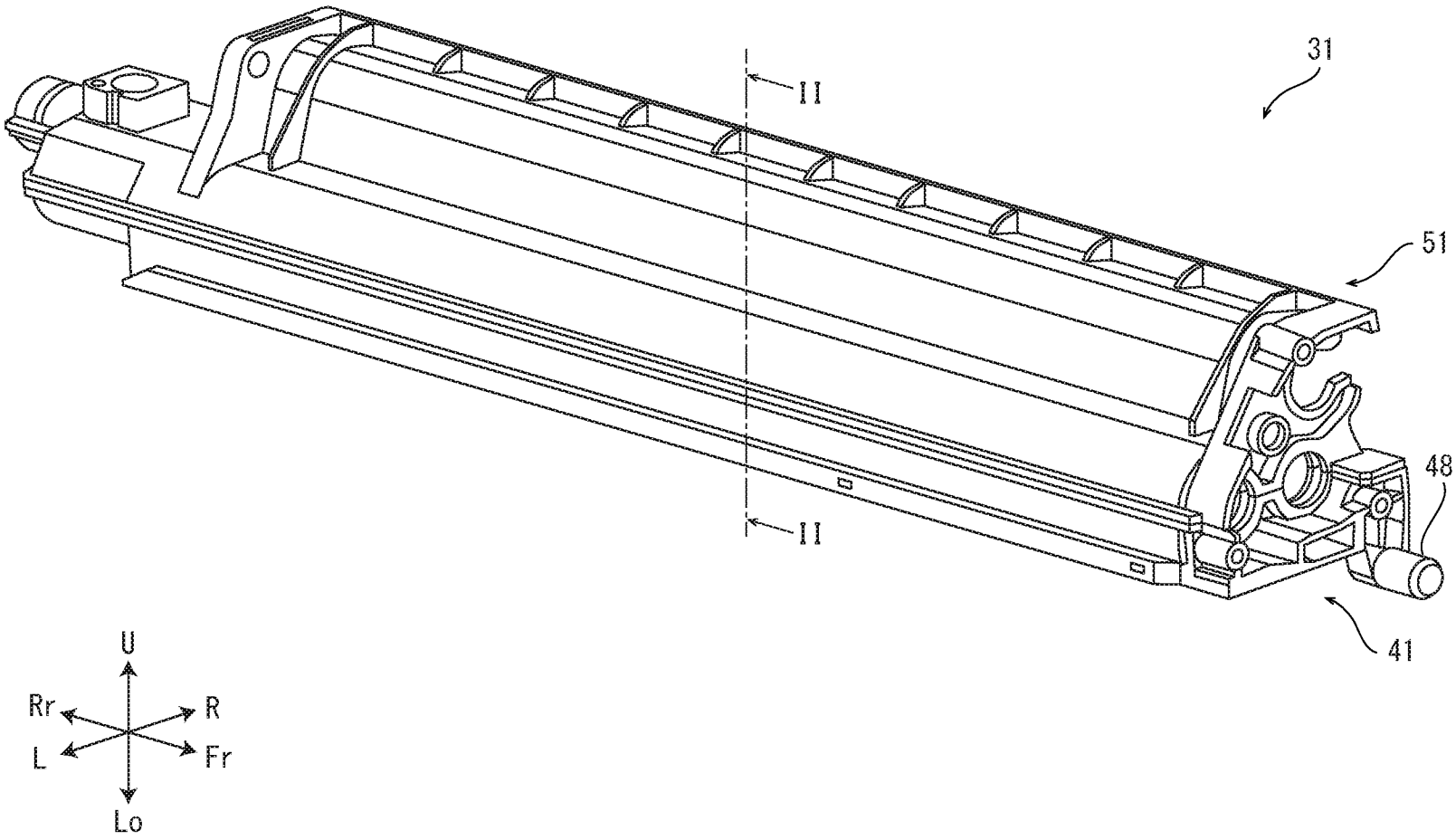
FIG. 2 is a perspective view showing an appearance of a housing of a development device according to the embodiment of the present disclosure.
Figure 3:
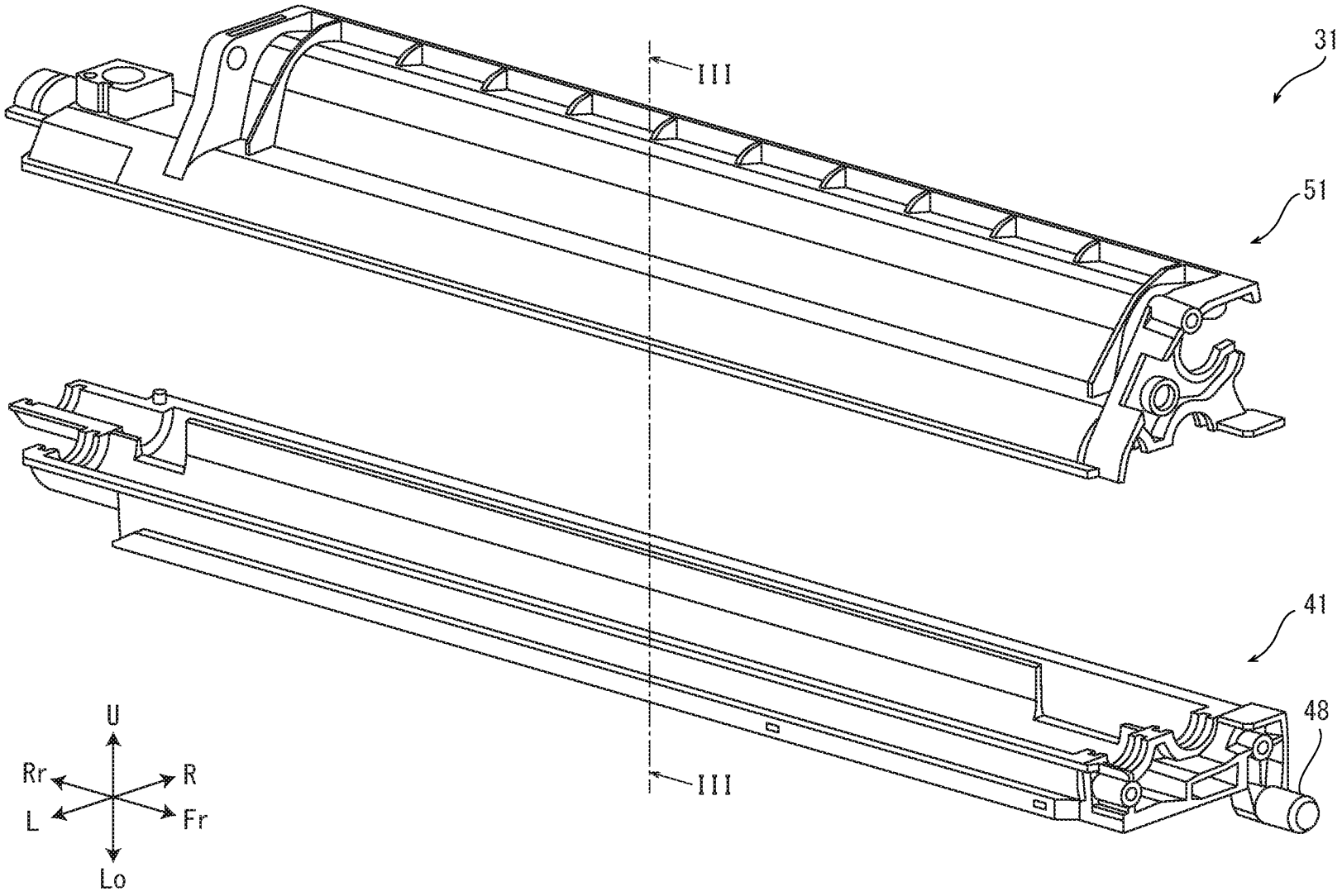
FIG. 3 is a perspective view showing an upper housing and a lower housing which are separated each other, in the development device according to the embodiment of the present disclosure.
Figure 4:
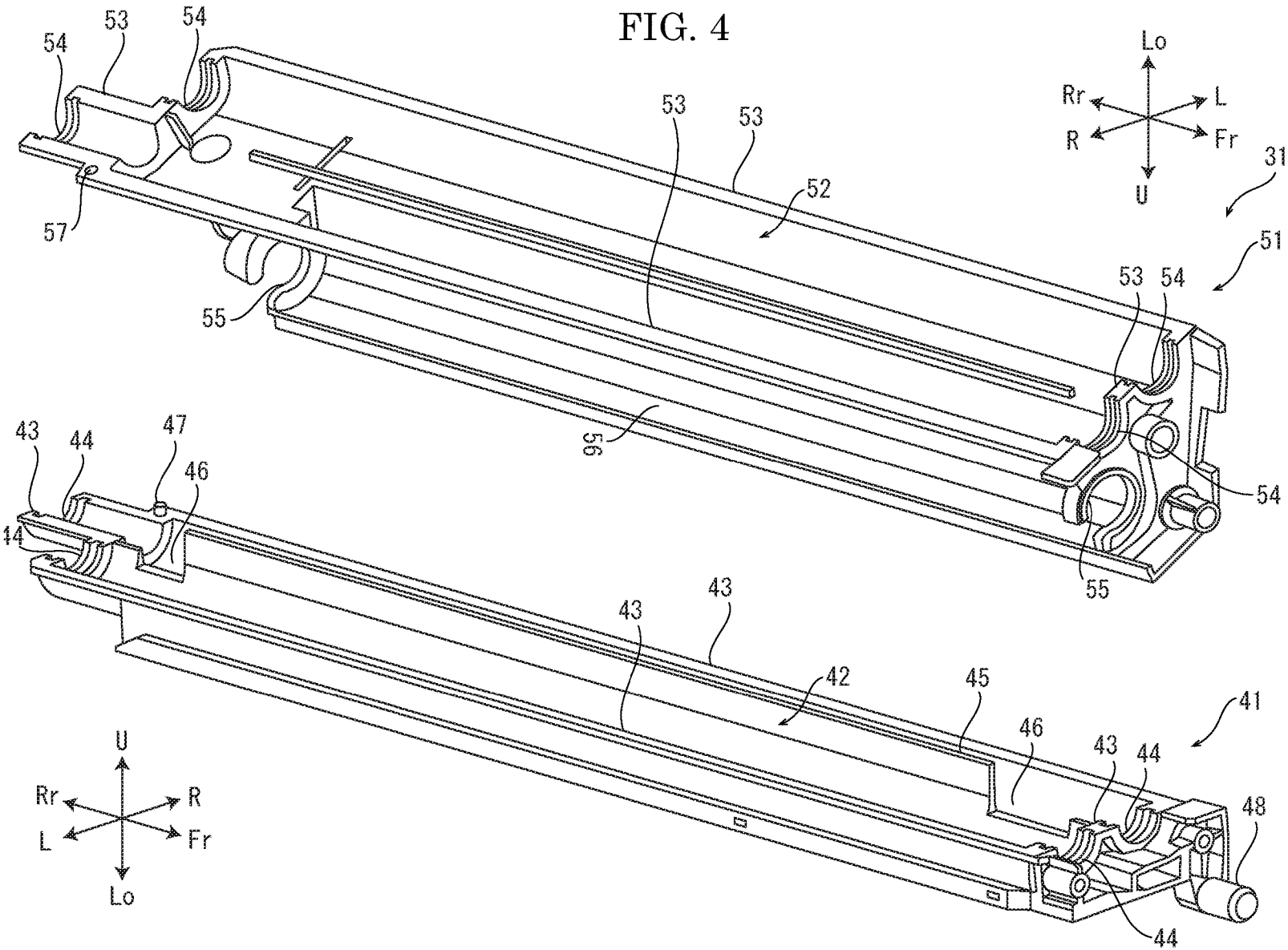
FIG. 4 is a perspective view showing a first edge portion and a second edge portion, in the development device according to the embodiment of the present disclosure.
Figure 5:
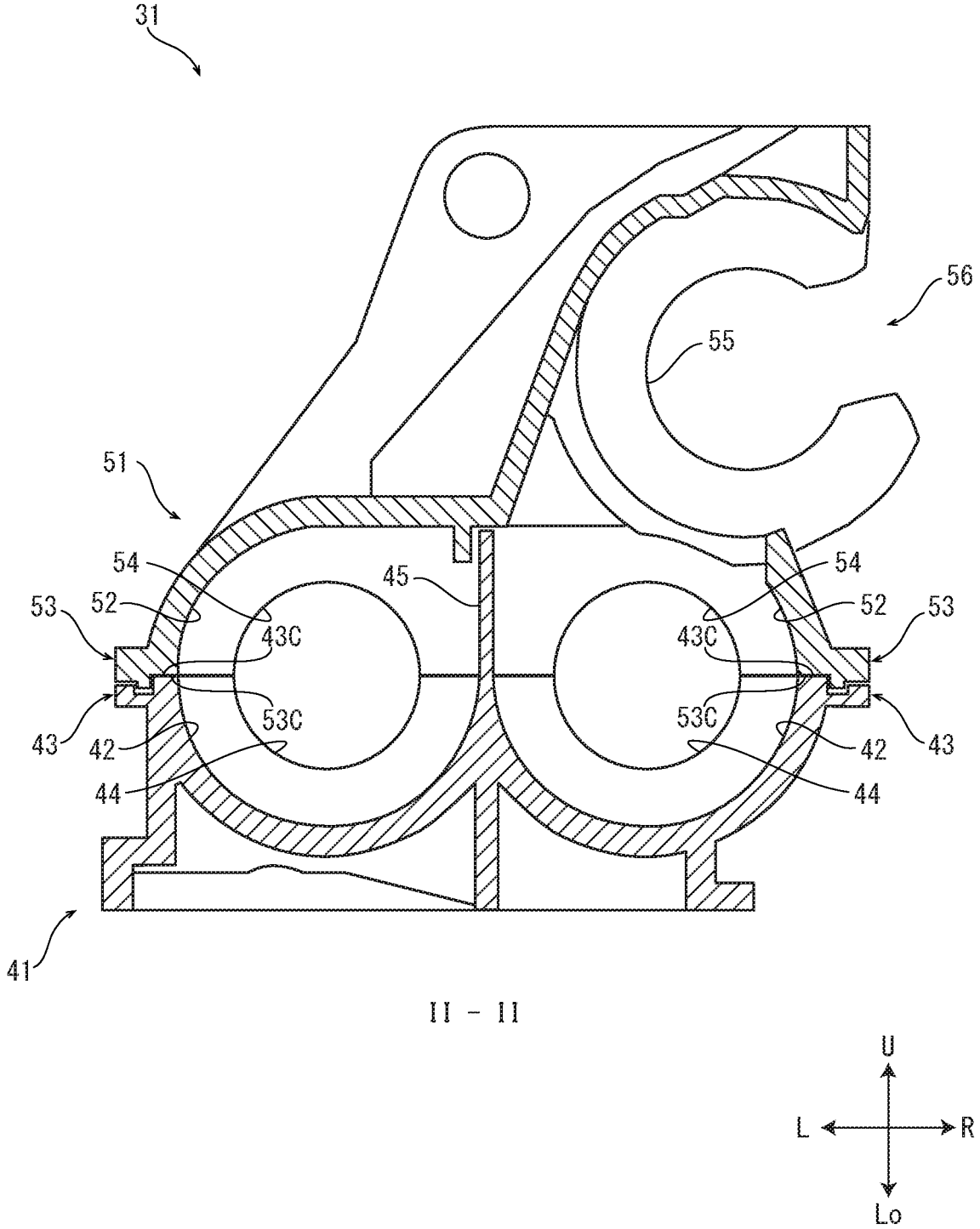
FIG. 5 is a sectional view along the II-II line in FIG. 2.
Figure 6:
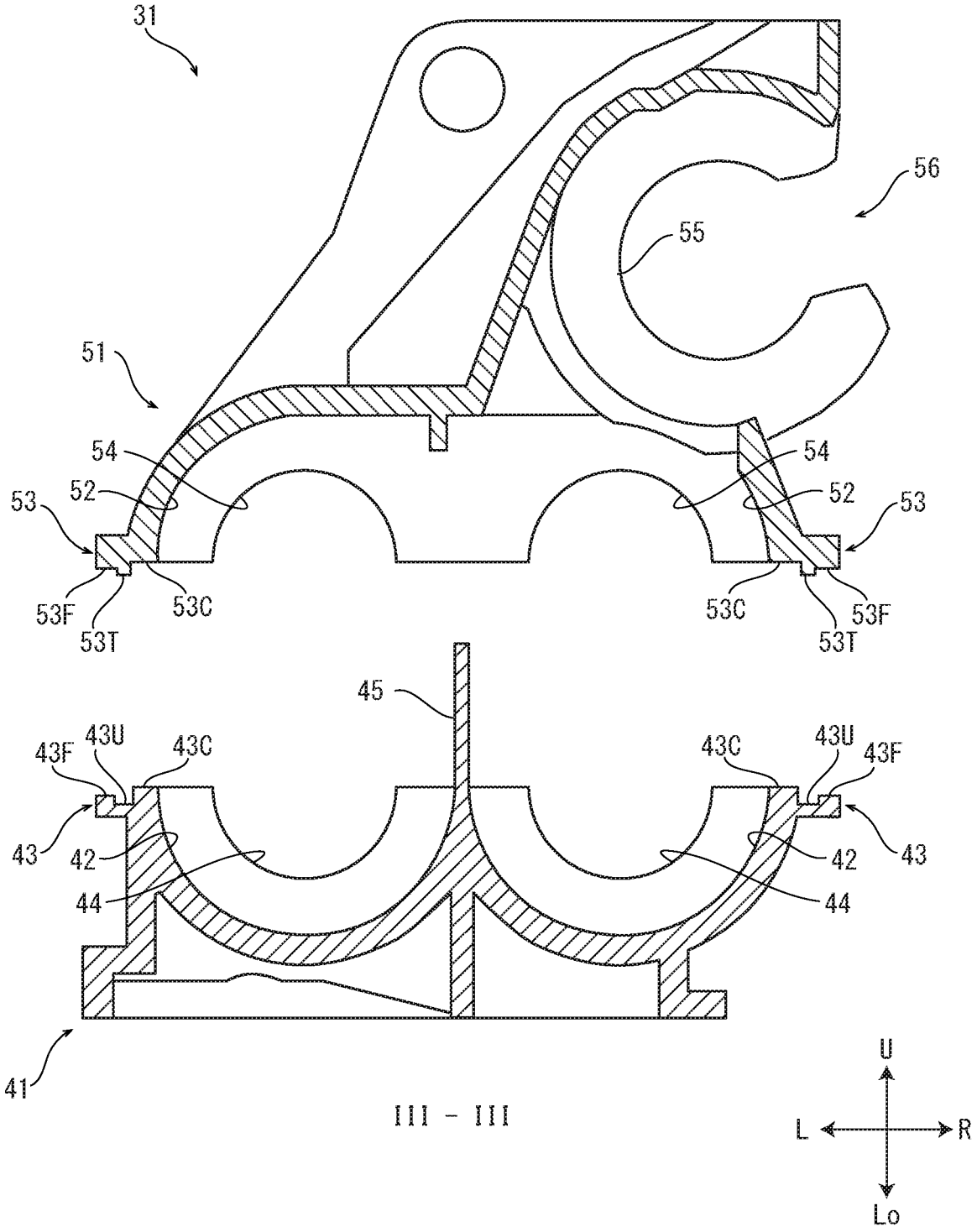
FIG. 6 is a sectional view along the III-III line in FIG. 2.
Figure 7:
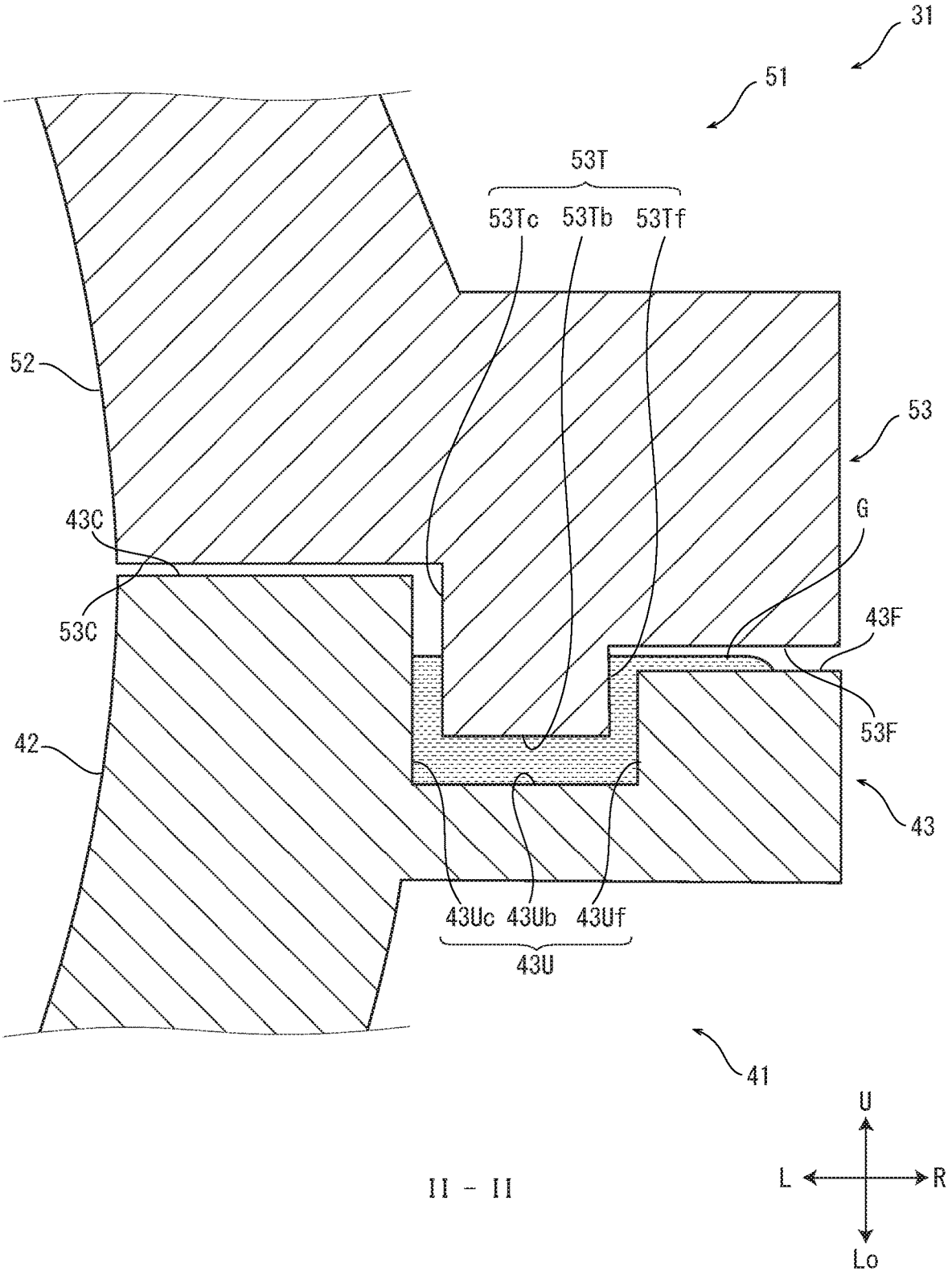
FIG. 7 is a sectional view showing the housing of a modified example, in the development device according to the embodiment of the present disclosure.

Next, with reference to FIG. 1 to FIG. 8, the housing 31 of the development device 16 will be described. FIG. 2 is a perspective view showing the appearance of the housing 31 of the development device 16. FIG. 3 is a perspective view showing a lower housing 41 and an upper housing 51 which are separated each other. FIG. 4 is a perspective view showing a first edge portion 43 and a second edge portion 53, and the upper housing 51 is shown upside down. FIG. 5 is a sectional view along the II-II line in FIG. 2. FIG. 6 is a sectional view along the III-III line in FIG. 3. FIG. 7 shows the right first and second edge portions 43 and 53 and their vicinity among the left and right first and second edge portions 43 and 53 shown on a II-II sectional view in FIG. 5. The left first and second edge portions 43 and 53 have the same structure except that the left and right sides are reverse.

The development device 16 includes the screws 33 each rotating around an axis and the housing 31 in which the screws 33 and the developer are stored. The housing 31 includes a lower housing 41 having a first concave storage part 42 whose upper face is opened and an upper housing 51 having a second concave storage part 52 whose lower face is opened. The upper housing 51 is disposed above the lower housing 41.

As shown in FIG. 2, the housing 31 of the development device 16 has a hollow structure whose longitudinal direction is along the front-and-rear direction. Inside the housing 31, the screws 33 and the magnetic roller 32 are stored. In the housing 31, the developer supplied from the developer container 12 is stored. As shown in FIG. 3, the housing 31 is formed by adhering the upper housing 51 to the lower housing 41. The lower housing 41 and the upper housing 51 are formed by injection molding.

As shown in FIG. 4 to FIG. 6, the lower housing has the first concave storage part 42 whose longitudinal direction is along in the front-and-rear direction. The upper face of the first storage part 42 is opened. The first storage part 42 has a cross section in which two semicircular cross sections are arranged side by side in the left-and-right direction. The first storage part 42 has a partition wall 45 at the center portion in the left-and-right direction extending along the front-and-rear direction. The screws 33 (refer to FIG. 1) are disposed on a left side and a right side of the partition wall 45, respectively. The front end portion and the rear end portion of the housing 31 each has bearing supporting parts 44 to which the bearings of the screws 33 is supported. The bearing supporting part 44 has a semicircular cross section. Between the front end portion of the first storage part 42 and the front end portion of the partition wall 45, and between the rear end portion of the first storage part 42 and the rear end portion of the partition wall 45, the respective gaps 46 are formed. Thus, a circulation path along which the developer is conveyed is formed around the partition wall 45. As shown in FIG. 2 to FIG. 4, from the front end portion of the lower housing 41, a pin 48 (an example of a rotational shaft) protrudes forwardly. From the rear end portion of the lower housing 41, a pin 48 (not shown) protrudes rearwardly.

As shown in FIG. 6 and FIG. 7, on a first edge portion 43 of the first storage part 42 except the bearing supporting parts 44, a recess 43U whose upper face is opened is formed along the first edge portion 43. Inside the recess 43U of the first edge portion 43, a first contact face 43C is formed. Outside the recess 43U of the first edge portion 43, a first opposite face 43F is formed. The first contact face 43C is higher than the first opposite face 43F. The recess 43U has an inner side face 43Uc (one side face on a side of the first contact face 43U), an outer side face 43Uf (the other side face on a side of the first opposite face 43F) and a bottom face 43Ub. As shown in FIG. 4, the first edge portion 43 has at least one protrusion 47 protruding upwardly.

As shown in FIG. 4 to FIG. 6, the upper housing has the second concave storage part 52 whose longitudinal direction is along in the front-and-rear direction. The lower face of the second storage part 52 is opened. The front end portion and the rear end portion of the upper housing 51 each has bearing supporting parts 54 to which the bearings of the screws 33 are supported. Above the right bearing supporting part 54, a bearing supporting part 55 is formed so as to support a bearing of the magnetic roller 32. The second storage part 52 is formed into a shape to cover the screw 33 (not shown) supported by the left bearing supporting parts 54 and the magnetic roller 32 (not shown) supported by the bearing supporting parts 55 from the upper side. On a right side of the magnetic roller 32, an opening 56 is formed.

As shown in FIG. 6 and FIG. 7, on a second edge portion 53 of the second storage part 52 except the bearing supporting parts 54, a protrusion 53T protruding downwardly is formed along the second edge portion 53. The protrusion 53T is fitted into the recess 43U of the first edge portion 43. Inside the protrusion 53T of the second edge portion 53, a second contact face 53C coming contact with the first contact face 43C is formed. Outside the protrusion 53T of the second edge portion 53, a second opposite face 53F opposing to the first opposite face 43F is formed. The second contact face 53C is higher than the second opposite face 53F. The protrusion 53T has an inner side face 53Tc (one side face on a side of the second contact face 53C), an outer side face 53Tf (the other side face on a side of the second opposite face 53F), and a top face 53Tb. As shown in FIG. 4, the second edge portion 53 has a hole 57 into which the protrusion 47 of the first edge portion 43 is fitted.

The inner side face 43Uc of the recess 43U has a length in the upper-and-lower direction longer than a length of the inner side face 53Tc of the protrusion 53T in the upper-and-lower direction. The outer side face 43Uf of the recess 43U has a length in the upper-and-lower direction longer than a length of the outer side face 53Tf of the protrusion 53T in the upper-and-lower direction. When the protrusion 53T is fitted into the recess 43U, a gap is formed between the top face 53Tb of the protrusion 53T and the bottom face 43Ub of the recess 43U, and a gap is formed between the first opposite face 43F and the second opposite face 53F.

The protrusion 53T has a width in the left-and-right direction wider than a width of the recess 43U in the left-and-right direction. When the protrusion 53T is fitted into the recess 43U, a gap is formed between the inner side face 43Uc of the recess 43U and the inner side face 53Tc of the protrusion 53T, and a gap is formed between the outer side face 43Uf of the recess 43U and the outer side face 53Tf of the protrusion 53T.

The bearings of the screws 33 are fitted into the bearing supporting portions 44 and 54, and then the screws 33 are stored in the first storage part 42. An adhesive G is applied to the first edge portion 43 or the second edge portion 53, and the protrusion 47 is inserted in the hole 57. Then, the upper housing 51 is positioned with respect to the lower housing 41, and the lower housing 41 and the upper housing 51 are adhered. The screws 33 are stored in a space formed by the first storage part 42 and the second storage part 52. The bearings of the magnetic roller 32 are fitted into the bearing supporting parts 55. The pins 48 of the lower housing 41 are inserted into supporting holes (not shown) of the housing 2. The housing 31 is supported by the housing 2 in a turnable manner around the pins 48, and the posture of the housing 31 is adjusted such that a distance between the magnetic roller 32 and the photosensitive drum 21 becomes an optimum value.

Next, behavior of the adhesive G will be described. When the adhesive G leaks inside the housing 31, the adhesive G solidified inside the housing 31 interferes with the agitation and the conveyance of the developer. In order to prevent the leakage of the adhesive G inside the housing 31, it is preferable to apply the adhesive G to the recess 43U or the protrusion 53T without applying the adhesive G to the first contact face 43C and the second contact face 53C and to interpose the adhesive G only between the recess 43U and the protrusion 53T. However, depending on an amount of the adhesive G, the adhesive G may leak from the gap between the recess 43U and the protrusion 53T. In the present embodiment, as shown in FIG. 7, the first contact face 43C is higher than the first opposite face 43F and the second contact face 53C is higher than the second opposite face 53F so that the excess adhesive G leaks over the outer side face 43Uf of the recess 43U to the gap between the first opposite face 43F and the second opposite face 53F. Accordingly, the excess adhesive G is prevented from being leaked over the inner side face 43Uc of the recess 43U to the gap between the first contact face 43C and the second contact face 53C.

According to the development device 16 of the above described embodiment, it becomes possible to introduce the excess adhesive G outside the housing 31.

According to the development device 16 of the present embodiment, compared with a case where the less rigid cover is mounted to the upper opened face of the housing, the lower housing 41 and the upper housing 51 are integrated together along the entire circumferences of the screws 33 (except the opening 56) so that a strength and a rigidity of the housing 31 are improved.

In a case where the housing 31 is supported in a turnable state around the pins 48, twist or distortion of the housing 31 may be affected on the positioning accuracy of the magnetic roller 32. However, according to the development device 16 of the present embodiment, a torsional rigidity and a bending rigidity of the housing 31 is improved so that the twist and the distortion of the housing 31 hardly occurs and a positioning accuracy of the magnetic roller 32 is improved. Additionally, the degree of freedom in material selection is increased, and it becomes possible to decrease the cost owing to the decreasing the average wall thickness.

According to the development device 16 of the present embodiment, a gap is hardly generated between the first contact face 43C and the second contact face 53C, and a sealing performance of the housing 31 is improved. Additionally, it becomes possible to decrease the cost by reducing the use of sealing material such as sponge.

According to the development device 16 of the present embodiment, the housing 31 is formed by adhering the lower housing 41 and the upper housing 51 so that a sealing performance of the housing 31 is improved compared with a case where they are connected using a screw or the like.

Accordingly, according to the development device 16 of the present embodiment, it becomes possible to improve a sealing performance, a strength and a rigidity of the housing 31 and to introduce the leaked adhesive G to outside the housing 31.

The above embodiment may be modified as follows.

Figure 8:
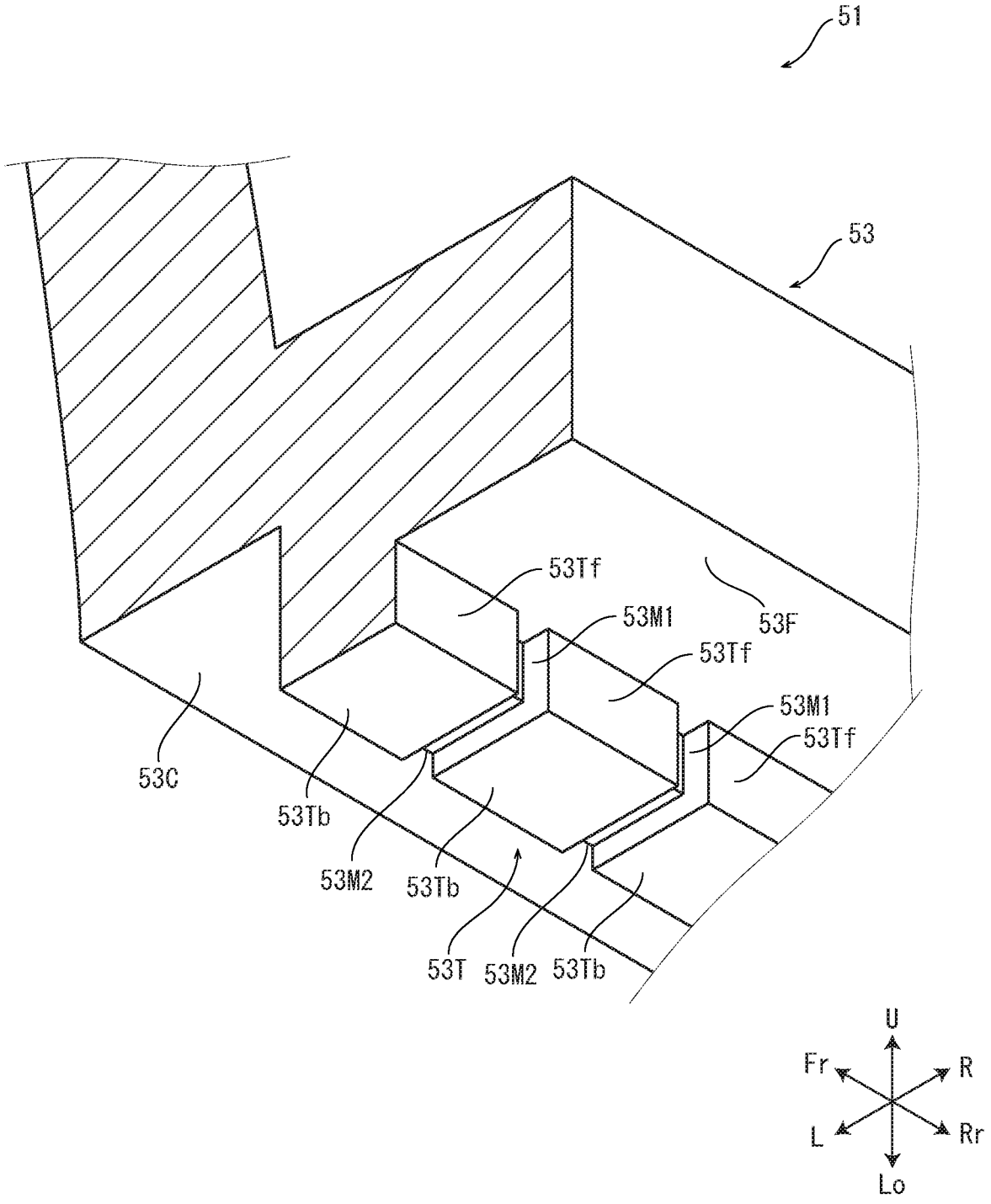
FIG. 8 is a perspective view showing the upper housing of a modified example, in the development device according to the embodiment of the present disclosure.
Figure 9:
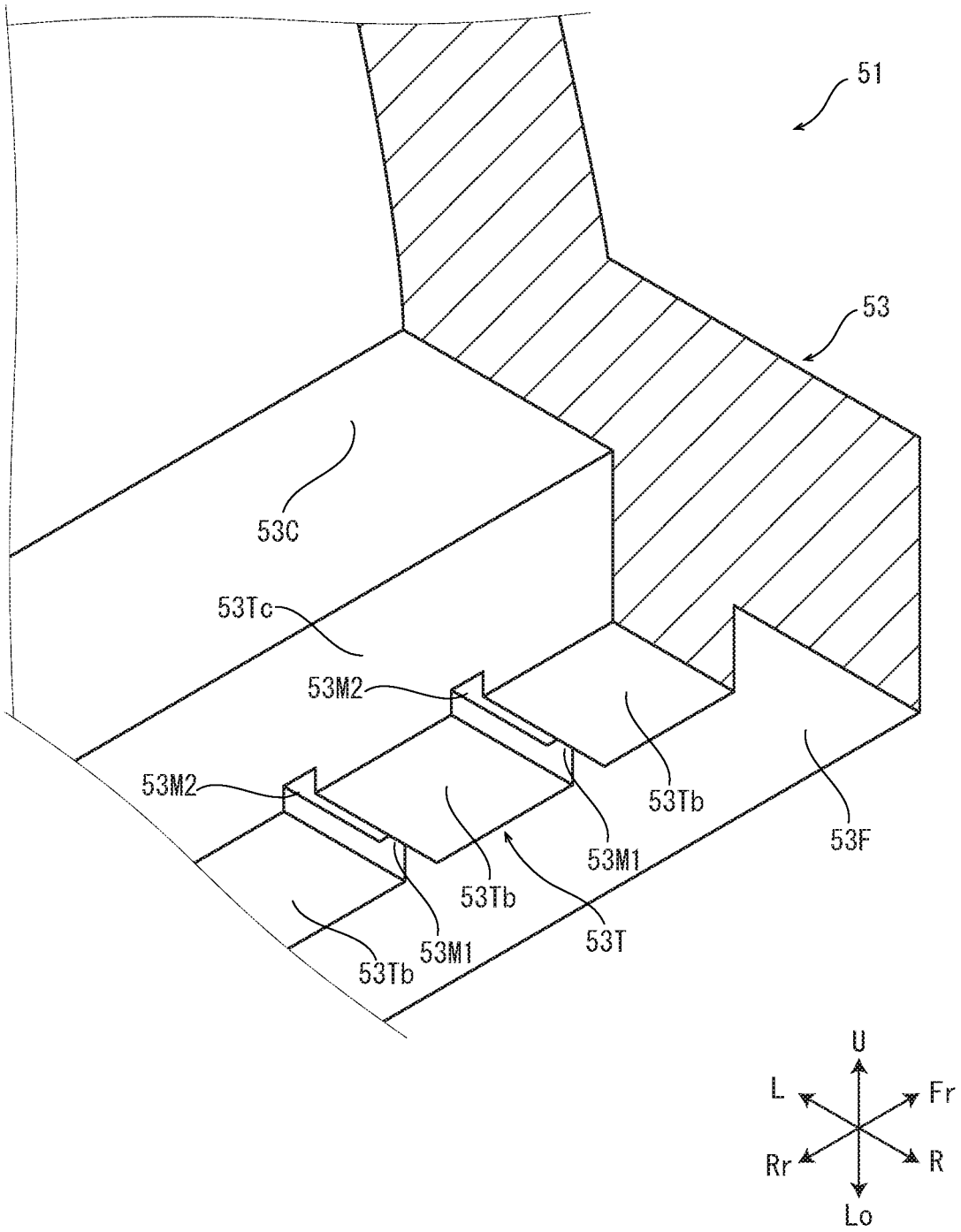
FIG. 9 is a perspective view showing the upper housing of a modified example, in the development device according to the embodiment of the present disclosure.

FIG. 8 and FIG. 9 are perspective views showing the upper housing 51 of the modified example. As shown in figures, the outer side face 53Tf (the other side face on a side of the second opposite face 53F) of the protrusion 53T may have a first groove 53M1 extending along the upper-and-lower direction, and the top face 53Tb of the protrusion 53T may have a second groove 53M2 extending in the left-and-right direction (a direction crossing to the outer side face 53Tf). The second groove 53M2 is communicated with the first groove 53M1. According to the configuration, the first groove 53M1 and the second groove 53M2 are functioned as a flow pass for the adhesive G so that the flow of the adhesive G to the outside of the housing 31 is enhanced. The second groove 53M2 may be not provided.

Figure 10:
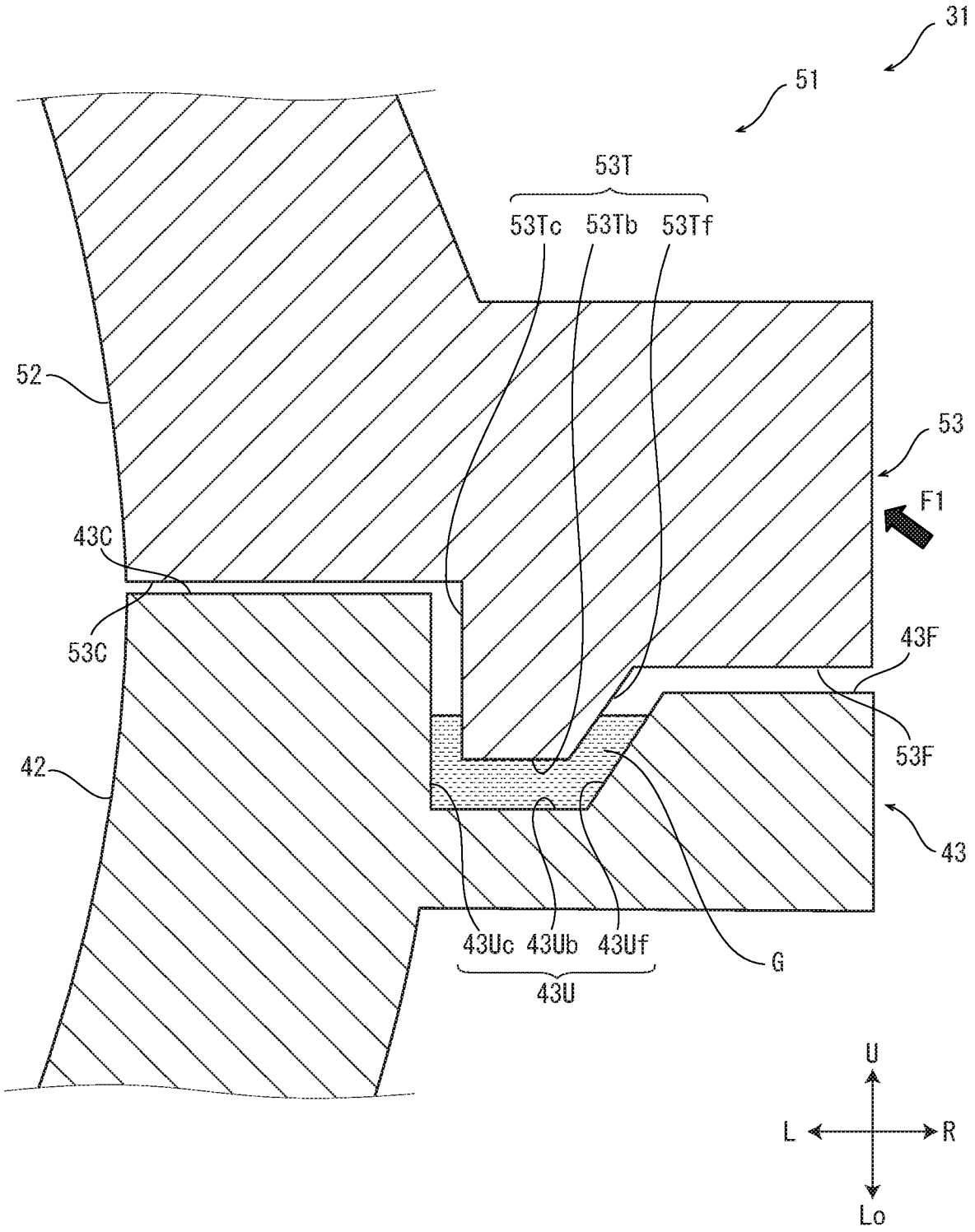
FIG. 10 is a sectional view showing the housing of a modified example, in the development device according to the embodiment of the present disclosure.

FIG. 10 is a sectional view showing the housing 31 of the modified example. As shown in figure, the lower housing 41 has pins 48 (an example of a rotational shaft) axially protruding from both the axially end portions below the first storage part 42. Additionally, an angle between the outer side face 43Uf (the other side face on a side of the first opposite face 43F) of the recess 43U and the first opposite face 43F may be an obtuse angle, and an angle between the outer side face 53Tf (the other side face on a side of the second opposite face 53F) of the protrusion 53T and the second opposite face 53F may be an obtuse angle. As described above, the housing 31 is supported by the casing 2 in a turnable manner around the pins 48, and a posture of the housing 31 is adjusted such that a distance between the magnetic roller 32 and the photosensitive drum 21 becomes an optimum value. In the cross section shown in FIG. 10, the photosensitive drum 21 is disposed on a right side of the housing 31 (not shown). For example, in a case where the housing 31 is positioned by bringing the upper housing 51 into contact with a positioning member (not shown) fixed to the portion between the photosensitive drum 21 and the housing 31, the upper housing 51 is applied with external force F1 shown in FIG. 10. The external force F1 acts as a load for separating the upper housing 51 from the lower housing 41. In the present modified example, the layer of the adhesive G between the outer side face 43Uf of the recess 43U and the outer side face 53Tf of the protrusion 53T is almost perpendicular to the external force F1. Although the adhesive G has a strong property for resisting a tensile load and a weak property for resisting a share load, in the modified example, because the external force F1 acts mainly as a tensile load on the layer of the adhesive G while a share load is negligibly small, it becomes possible to increase an adhesive strength between the lower housing 41 and the upper housing 51.

Figure 11:
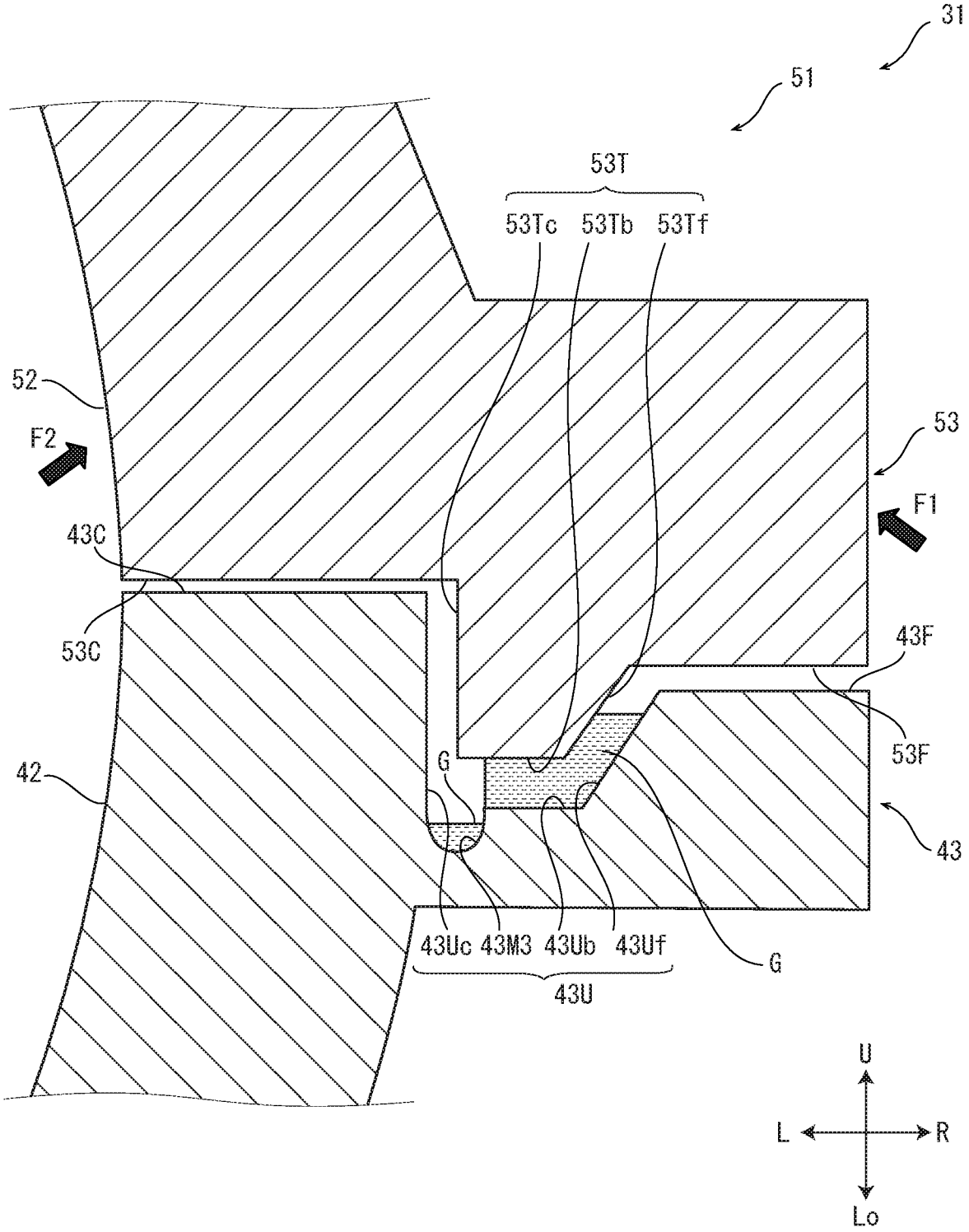
FIG. 11 is a sectional view showing the housing of a modified example, in the development device according to the embodiment of the present disclosure.

FIG. 11 is a sectional view showing the housing 31 of the modified example. As shown in figure, the bottom face 43Ub of the recess 43U may have a third groove 43M3 extending along the inner side face 43Uc (one side face on a side of the first contact face 43C) of the recess 43U, and the inner end portion (the end portion on a side of the second contact face 53C) of the top face 53Tb of the protrusion 53T may be inside (on a side of the first contact face 43C) the outer end portion (the end portion on a side of the first opposite face 43F) of the third groove 43M3. According to the configuration, because the adhesive G is flowed to the third groove 43M3, a region where is not adhered is produced in the inner end portion of the top face 53Tb of the protrusion 53T. Then, when the external force F2 is applied, a tensile stress is concentrated on a boundary portion between the region where is not adhered and the other region where is adhered. According to the configuration, because an adhesive strength for the external strength F2 is weakened, it is suitable for disassembling the housing.

Figure 12:
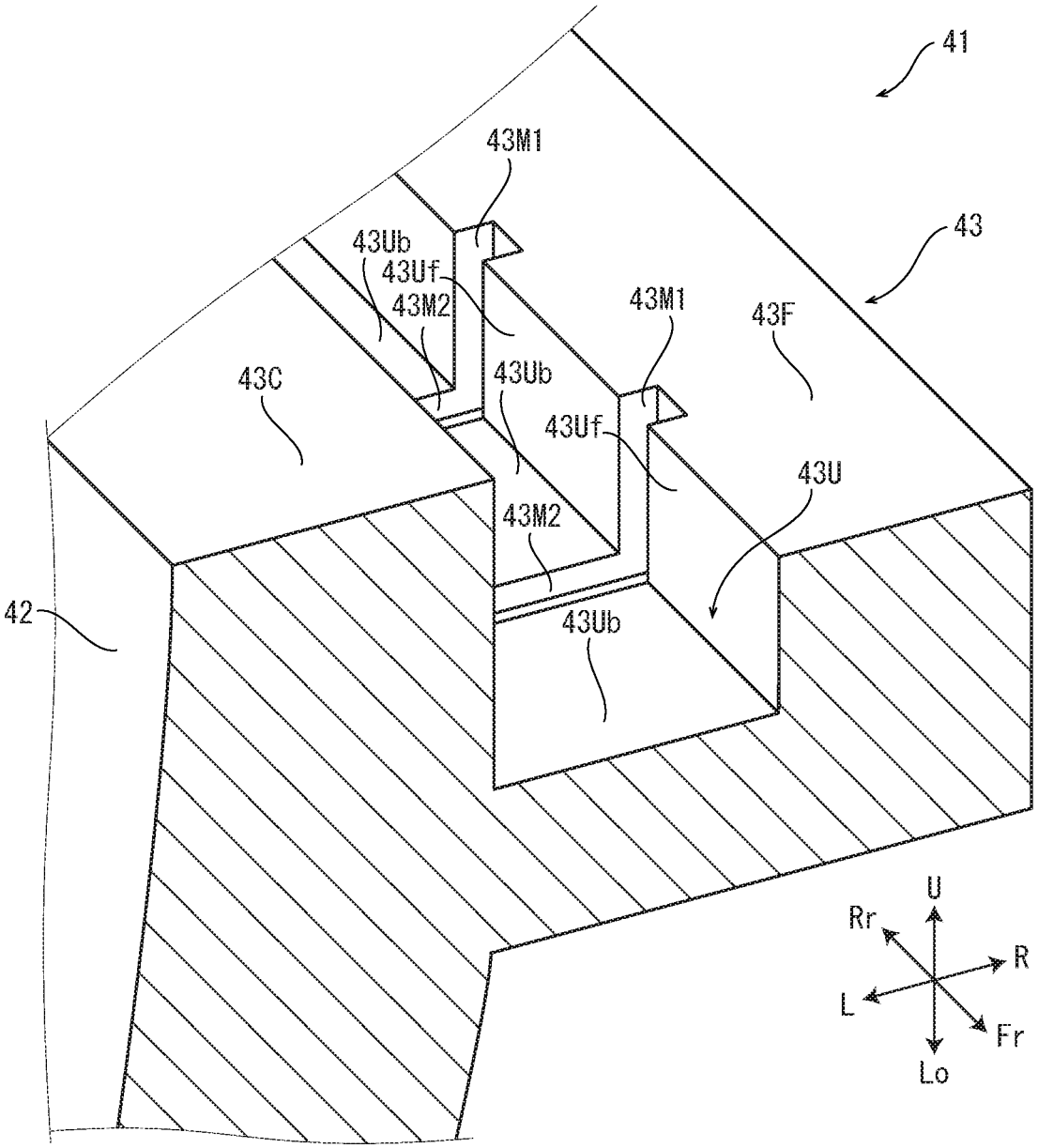
FIG. 12 is a perspective view showing the lower housing of a modified example, in the development device according to the embodiment of the present disclosure.
Figure 13A:
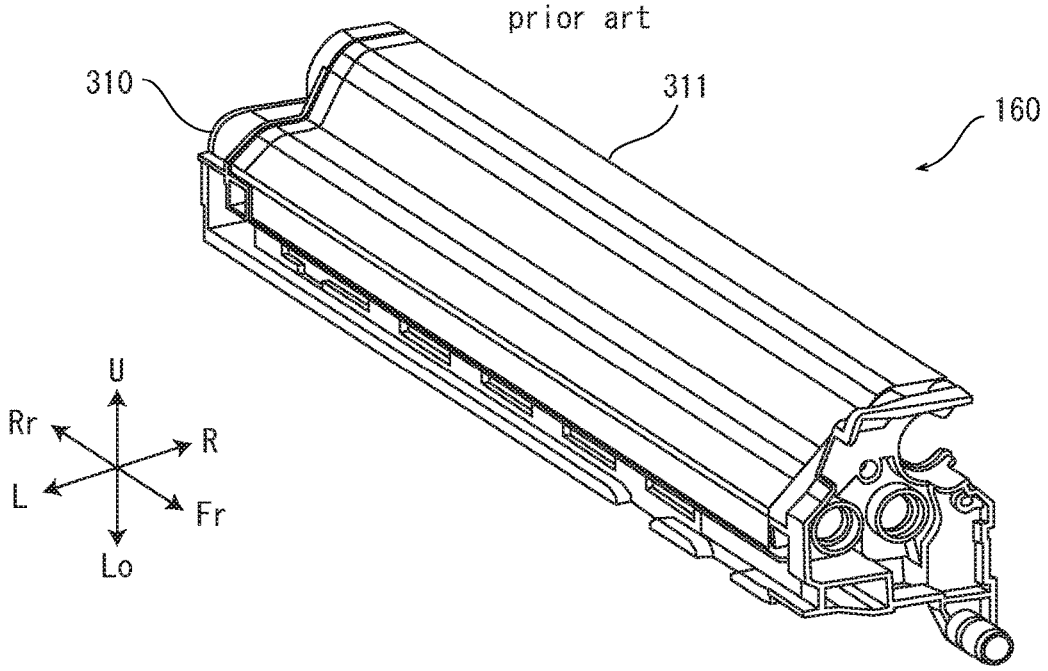
FIG. 13A prior art
FIG. 13A is a perspective view sowing an appearance of a conventional development device.
Figure 13B:
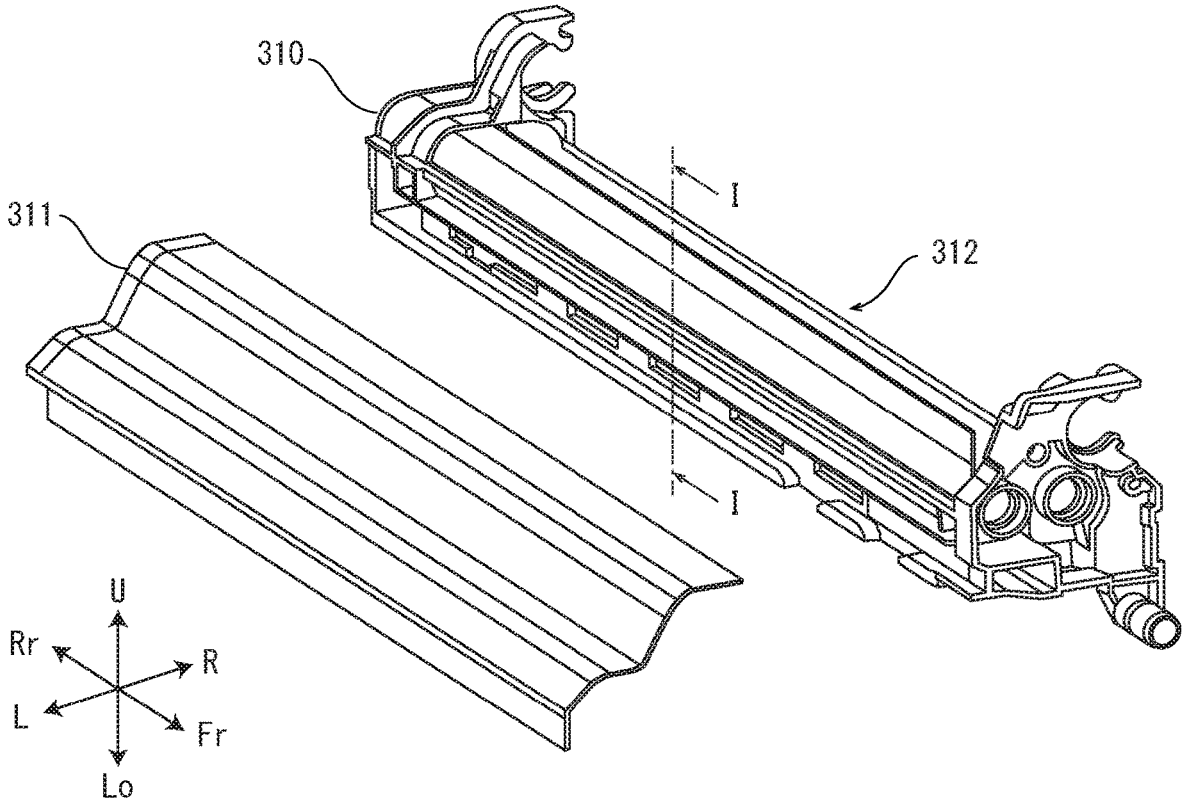
FIG. 13B prior art
FIG. 13B is a perspective view showing a housing from which a cover is removed, in the conventional development device.
Figure 14:
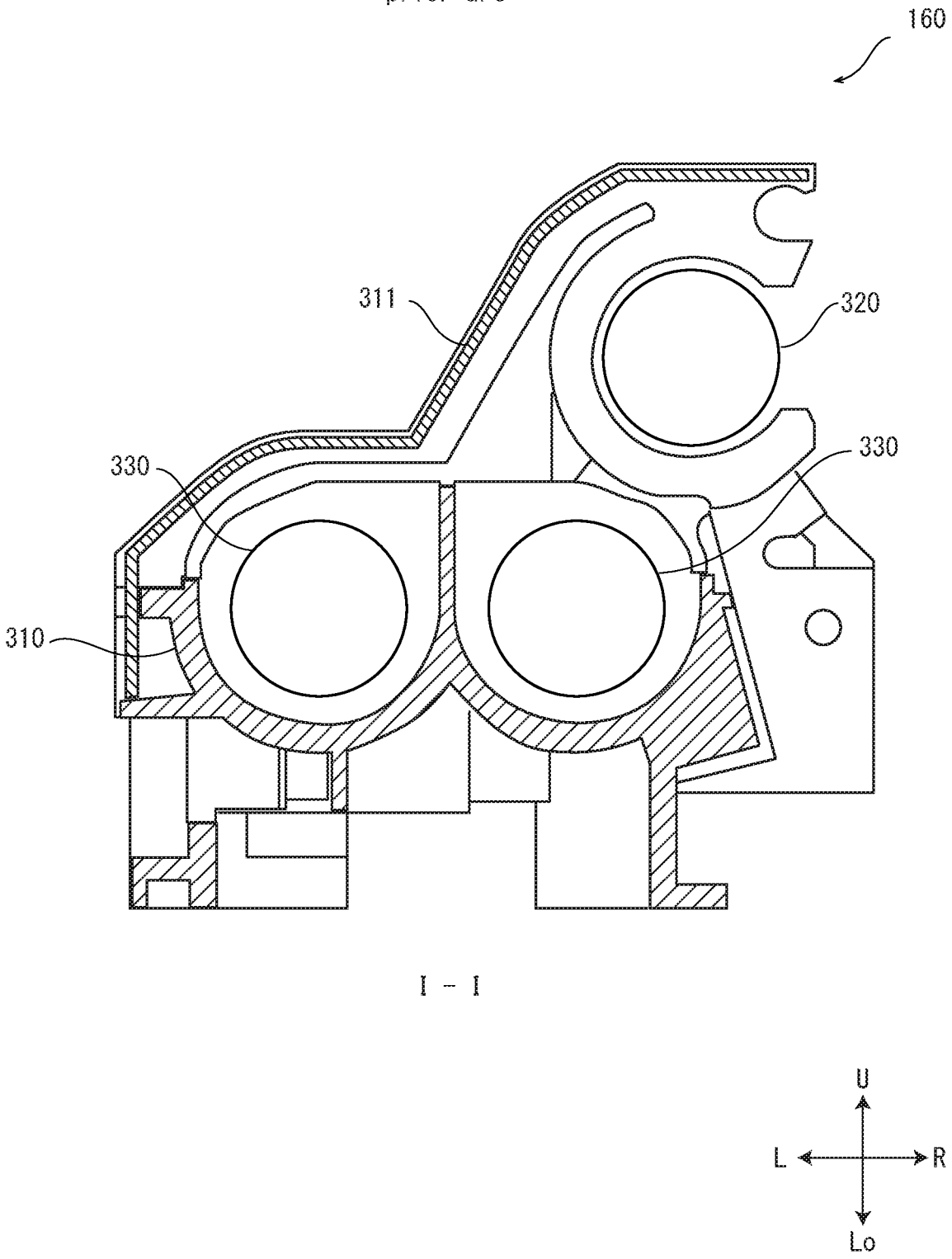
FIG. 14 prior art
FIG. 14 is a sectional view along the I-I line in FIG. 13B.

FIG. 12 is a perspective view showing the upper housing 51 of the modified example. As shown in figure, the outer side face 43Uf (the other side face on a side of the first opposite face 43U) of the recess 43U may have a first groove 43M1 extending along the upper-and-lower direction, and the bottom face 43Ub of the recess 43U may have a second groove 43M2 extending in the left-and-right direction (a direction crossing to the outer side face 43Uf). The first groove 43M1 is communicated with the second groove 43M2. According to the configuration, the first groove 43M1 and the second groove 43M2 are functioned as a flow pass for the adhesive G, so that the flow of the adhesive G to the outside of the housing 31 is enhanced. The second groove 43M2 may not be provided.

In the above embodiment, the screw 33 is an example of the rotating member. However, the magnetic roller 32 or a development roller of a touchdown type development device which supplies the toner to the photosensitive drum from the magnetic roller via the development roller may be an example of the rotating member.

The invention claimed is:

1. A development device comprising:

a rotational member rotating around an axis; and a housing in which the rotational member and a toner are stored, wherein the housing includes:

a lower housing having a concave first storage part having an opened upper face; and an upper housing having a concave second storage part having an opened lower face, and disposed above the lower housing, wherein the first storage part has a first edge portion around the opened upper face, the first edge portion has:

a recess extending along the first edge portion, the recess having an opened upper face, a first contact face formed inside the recess; and a first opposite face formed outside the recess, the second storage part has a second edge portion around the opened lower face, the second edge portion has:

a protrusion fitted into the recess;

a second contact face coming into contact with the first contact face; and a second opposite face opposing the first opposite face, wherein the first contact face is higher than the first opposite face, the second contact face is higher than the second opposite face, and at least the recess and the protrusion are adhered with an adhesive.

2. The development device according to claim 1, wherein the recess has an inner side face on a side of the first contact face, an outer side face on a side of the first opposite face and a bottom face, the protrusion has an inner side face on a side of the second contact face, an outer side face on a side of the second opposite face and a top face, the inner side face of the recess has a vertical length longer than a vertical length of the inner side face of the protrusion, and the outer side face of the recess has a vertical length longer than a vertical length of the outer side face of the protrusion, wherein when the protrusion is fitted into the recess, a gap is formed between the top face of the protrusion and the bottom face of the recess, and a gap is formed between the first opposite face and the second opposite face.

3. The development device according to claim 1, wherein the recess has an inner side face on a side of the first contact face, an outer side face on a side of the first opposite face and a bottom face, the protrusion has an inner side face on a side of the second contact face, an outer side face on a side of the second opposite face and a top face, the protrusion has a width wider than a width of the recess, wherein when the protrusion is fitted into the recess, a gap is formed between the inner side face of the recess and the inner side face of the protrusion, and a gap is formed between the outer side face of the recess and the outer side face of the protrusion.

4. The development device according to claim 1, wherein the protrusion has an inner side face on a side of the second contact face, an outer side face on a side of the second opposite face and a top face, the outer side face of the protrusion has a first groove extending vertically.

5. The development device according to claim 4, wherein the top face of the protrusion has a second groove extending in a direction crossing to the outer side face and communicating with the first groove.

6. The development device according to claim 1, wherein the recess has an inner side face on a side of the first contact face, an outer side face on a side of the first opposite face and a bottom face, the outer side face of the recess has a first groove extending vertically.

7. The development device according to claim 6, wherein the bottom face of the recess has a second groove extending in a direction crossing to the outer side face and communicating with the first groove.

8. The development device according to claim 6, wherein the bottom face of the recess has a third groove extending along the inner side face of the recess, the protrusion has an inner side face on a side of the second contact face, an outer side face on a side of the second opposite face and a top face, and an end portion of the top face of the protrusion on a side of the second contact face is positioned closer to the first contact face than an end portion of the third groove on a side of the first opposite face.

9. The development device according to claim 1, wherein the lower housing has a rotational shaft which protrudes in an axial direction of the rotational member from an axially end portion below the first storage part, the recess has an inner side face on a side of the first contact face, an outer side face on a side of the first opposite face and a bottom face, and the protrusion has an inner side face on a side of the second contact face, an outer side face on a side of the second opposite face and a top face, wherein an angle between the outer side face of the recess and the first opposite face is an obtuse angle, and an angle between the outer side face of the protrusion and the second opposite face is an obtuse angle.

10. An image forming apparatus comprising:

an exposure device forming an electrostatic latent image on a photosensitive drum; and the development device according to claim 1, developing the electrostatic latent image.

* * * * *